United States Patent [19]

Meier

[11] Patent Number: 4,841,714

[45] Date of Patent: Jun. 27, 1989

[54] METHOD AND APPARATUS FOR THE FURTHER PROCESSING OF A PACKAGING LINE

[75] Inventor: Jacques Meier, Bäretswil, Switzerland

[73] Assignee: Ferag AG, Hinwil, Switzerland

[21] Appl. No.: 48,295

[22] Filed: May 11, 1987

[30] Foreign Application Priority Data

Jul. 21, 1986 [CH] Switzerland ..... 02910/86

[51] Int. Cl.[4] ..... B65B 35/00

[52] U.S. Cl. ..... 53/429; 53/116; 226/107

[58] Field of Search ..... 53/429, 116; 226/104, 226/107, 105, 106

[56] References Cited

U.S. PATENT DOCUMENTS

| | | | |
|---|---|---|---|
| 276,728 | 5/1883 | Staib | 226/107 |
| 1,125,363 | 1/1915 | Marresford | 226/107 |
| 1,903,325 | 4/1933 | Colbert et al. | 226/107 X |
| 2,109,301 | 2/1938 | Nakane | 226/107 X |
| 2,831,677 | 4/1958 | Elwood et al. | 226/107 X |
| 4,218,003 | 8/1980 | Plewa et al. | 226/104 |

*Primary Examiner*—James F. Coan

*Attorney, Agent, or Firm*—Armstrong, Nikaido Marmelstein Kubovcik & Murray

[57] ABSTRACT

The method for ordering a coherent packaging line is characterized in that prior to cutting the coherent packaging line into product portions, the latter are arranged in loop form, so that the loop apexes formed can be used for manipulation purposes. It is used for storage in transportable large units or for intermediate buffer storage during the packaging process. The apparatus is characterized by a conveying means with receptacles for positioning the loop apexes and at least one collecting device cooperating with the conveying means and having at least one gripper receiving the packaging line from the packaging machine and used for the formation of loop apexes, the collecting device being able to perform a collecting stroke enabling the packaging line received from the gripper to be transferred to a receptacle on the conveying means.

14 Claims, 4 Drawing Sheets

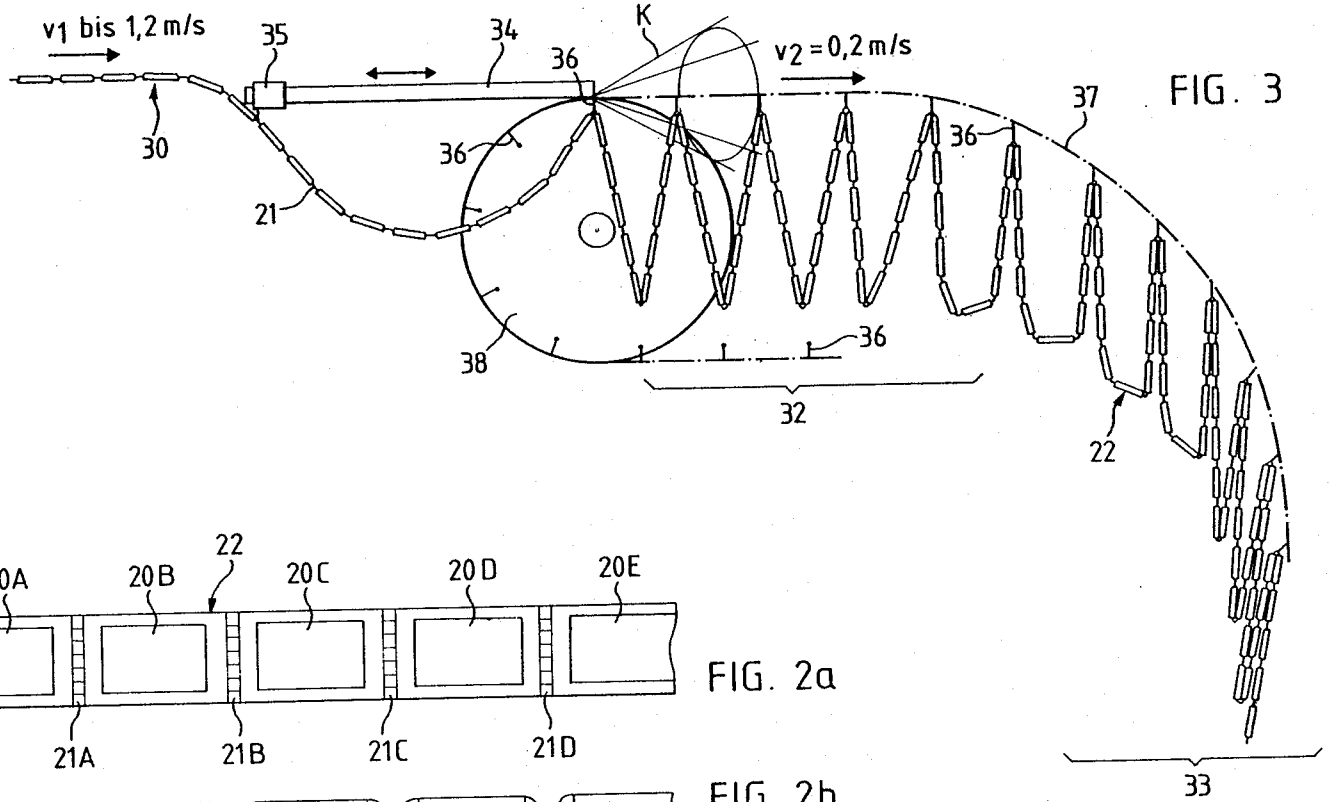
FIG. 3
FIG. 2a
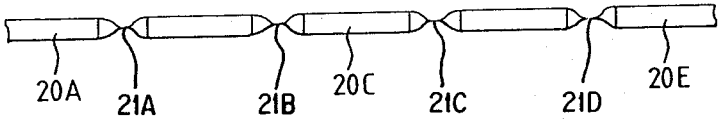
FIG. 2b

METHOD AND APPARATUS FOR THE FURTHER PROCESSING OF A PACKAGING LINE

BACKGROUND OF THE INVENTION

The present invention is in the field of transporting and conveying technology in high speed product manufacture and relates to a product transfer process in conjunction with a manufacturing process, in particular the taking over of a product output from a machine and the delayed transfer to the next production stage. The product transfer process is in a specific embodiment directed to the output of goods packed in a flow pack procedure.

A typical high speed manufacturing process, e.g. in chocolate manufacture starts with raw materials, which are generally automatically supplied to the production process from bin storage. Grinding, mixing, etc take place fully automatically, whilst mixing and stirring are generally automated production processes. An intermediate batch operation, e.g. the emptying of the stirrers into containers with a capacity of up to 70 tonnes of chocolate material admittedly interrupts the continuous material flow, but does not alter the high mass potential of the manufacturing process. The first bottleneck problems in the case of high material throughput occur in the following injection, pouring or moulding process, in which the unshaped material is to be converted into lump, i.e. portion form.

As a result of the amorphous presence of the intermediate products, up to this point the production process of the material flow can be controlled by using simple means, usually pipe connections, which permit a relatively simple pipelining, which is especially suitable for fully automatic material transfer, it is no longer possible to transfer with mass product transportation methods lumpy products, or preferably the portioned product, so as to bring about a distinction between e.g. lump coal, which can also be pipeline-transferred.

The bottleneck problems increase particularly in the packaging section of the manufacturing process, in which in a single packaging line, e.g. a discharge of 50 tonnes/day in e.g. 0.0001 t portions make it necessary to control 500,000 packaging processes. Generally several such packaging lines are installed and also simultaneously operated.

If at the time of portioning the material flow was split up into several injection lines, so as to avoid bottlenecks by simultaneous, parallel operations, this becomes unavoidable in the case of the serial process of packaging. Thus, each injection line is followed by several parallel-operating packaging lines, in which the chocolate bars (portions) produced in this example are packed by a flow pack process developed for high packaging speeds. Generally the flow pack line is subsequently cut into portions and the loose individual products are collected in some way.

This is where the inventive idea comes into play. Normally the material flow of packed products, in this case chocolate bars, are either fully automatically or manually further processed. Often this takes place by human hand, e.g. by standard packing in boxes and the like, so that a difficult to handle multiple form is brought into an easier to handle, but more complicated smaller form. No matter what packaging procedure is adopted, singling to give packable portions breaks up excessively early a process- inherent order or arrangement.

Process-inherent order means the following. Different operating stages are performed at different locations which, under certain circumstances, can be very close together or very far apart. The material must be conveyed from one processing or working operation to the other, whereby e.g. position changes or the like are necessary. They are to be looked upon as a linking operation for the next process stage and represent a given (transient) order in the overall flow. A disturbance to said order disturbs the sequence and the removal of the order blocks the sequence. These actions can be looked upon as "introduced" ordering elements. The process-inherent ordering elements are, however, implicit (already existing) elements and must be specially sought to render them usable. They are rarely obvious and in fact this is so rare that often ordering elements are introduced into a process, where it would in fact be possible to use a process-inherent order and it is even possible for a process-inherent order to be destroyed by an additional production stage and replaced by an "introduced" order.

SUMMARY OF THE INVENTION

The problem of the present invention is to provide a method for the further processing of a packaging union, e.g. flow pack, in which the transportation possibilities of the packed material are significantly increased and which in particular aids a high speed manufacturing process. The invention also relates to an apparatus for performing the method.

An example of this use is the further processing of a flow pack output of chocolate bars, but other products can also be used.

The solution of the inventive problem is shown on a specific embodiment and is described by the invention defined in the claims.

One of the possible uses of the inventive method and a specific embodiment of an apparatus for performing the use of the method are described hereinafter relative to the drawings.

BRIEF DESCRIPTION OF THE DRAWINGS

FIG. 2*a*, and FIG. 2*b*, part of a flow pack in plan and side view for explaining the object involved in the discussed process.

FIG. 3, a diagrammatic representation of the process on the output of a packaging machine (product transfer).

DETAILED DESCRIPTION OF THE INVENTION

Figure 1:
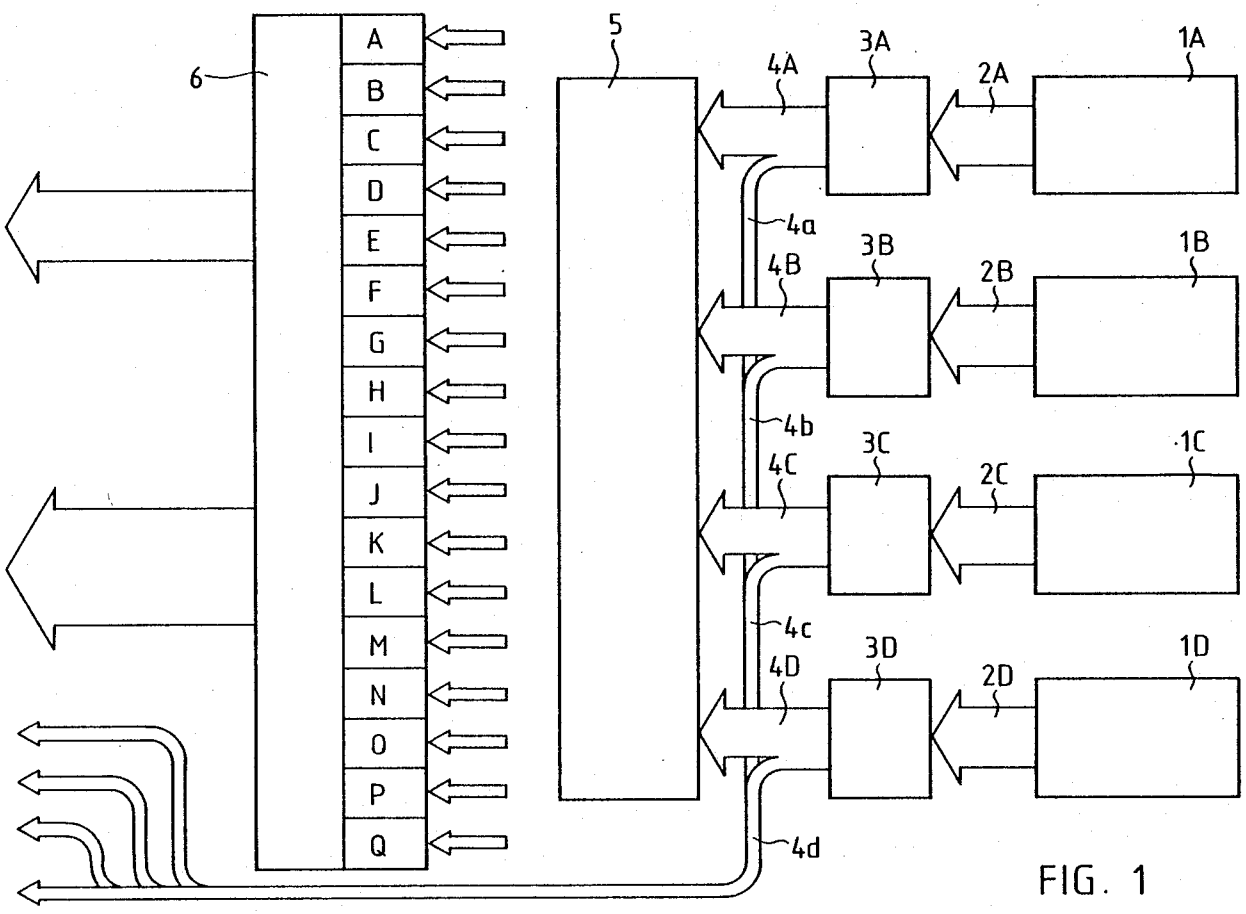
FIG. 1, a diagram of a material flow in the manufacture of a product.

FIG. 1 shows the last stations of a material flow in a manufacturing process and namely as from the portioning of a basic material (chocolate) and the associated subdivision into simultaneously operating production lines. This parallelization starts with bar means 1A to 1D, which receive a pasty material flow of e.g. 22.5 t/h and process same to given portions. Each bar means operates on one packaging unit 3A to 3D and each of the represented units can comprise several parallel-operating packaging lines. In the packaging lines the product is enveloped in the flow pack process, a type of hose bag pack. The packaging speed in a packaging line and therefore the output thereof is typically 1.0 to 1.5 m/s. The product flows 4A/a to 4D/d at the outlet of the packaging units reveals the following. A smaller product flow 4*a* is e.g. supplied with the full discharge rate to an automatic large pack, whereas a larger product flow 4A, which for some reason cannot be automatically packed and is therefore to be intermediately stored.

Thus, for the larger product flow 4A, the problem now arises of further processing, e.g. in a type mixing line 6 and/or intermediate storage in a intermediate store 5 for subsequent further processing in a type mixing line. This intermediate storage serves as a time buffer, whilst transportation can be provided over a longer or shorter distance. The method according to the invention now permits in an almost random manner such time buffering operations using process-inherent ordering elements, in that when they are used in the case of full product output the transfer rate can be reduced and the portioned material flow can be stopped in given spatial arrangement.

FIGS. 2*a/b*, from two viewing directions, show a typical hose bag pack with portions 20A to 20E, which are housed in a packaging hose 22. The individual portions are separated from one another in the hose by closure zones 21A to 21D. In the conventional flow pack process a cutting mechanism separates the flow pack union 22 into portions roughly in the centre of the closure zones. This singling was hitherto considered to be unavoidable, because in the case of an output of 1 to 1.5 m/s it was not possible to control the coherent flow pack union (material flow).

The present invention avoids this singling, in order to obtain and use a process-inherent order. There is no need for a cutting process and the high speed of the material flow can be reduced or even stopped by folding together the flow pack union. The process-inherent ordering element is the uncut or intact closure zone. The total number of intact closure zones orders the packed portions in a clearly defined row or union. FIG. 3 diagrammatically shows the folding together process. At the top left of FIG. 3 is shown the entry of the material flow 30 as a flow pack union with a discharge speed V1 of e.g. 1.2 m/s. As stated, there is no singling of the individual packs as a result of the omission of the cutting mechanism. A collecting device 34 with gripper 35 at its free end now draws at a speed of approximately V1 to the flow pack union to a conveying chain 37 running over a guide wheel 38 and having a plurality of equidistantly arranged hooks 36 and at given closure zones 21 transfers the flow pack union to the hooks 36 of chain 37. This leads to the loops shown to the right in FIG. 3. The degree of deflection of the collecting device 34 determines the loop length and the "scanning ratio" hooks 36/no hooks/36 is adjustable and determines the folding density on the one hand and the V1/V2 transformation on the other. The transformation here is 1.2 : 0.2, i.e. a slowing down to 1/6. Doubling the number of hooks would further halve the speed.

A further advantage of the presently discussed (hanging) 3-dimensional conveying is shown in FIG. 3 in the downward direction in space in transfer portions 32, 33. Utilizing gravity, so that the loops can be transferred in suspended manner, conveying chain 37 can now be spatially guided in the manner required by the local conditions. This deflectability, is represented here as a downwardly directed curve, is possible in all directions in space, i.e. up/down, left/right and in random intermediate paths. This is illustrated in FIG. 3 by a cone K pointing in a number of directions in space and which is shown at the transfer point of the packaging union from collecting device 34 to hooks 36. These paths can be linear or curved and the minimum radius is generally limited by the conveying means, i.e. the conveying chain 37 in this case.

A conveying away of the packaging union in any random direction in space in virtually randomly curved paths would not be allowed by the packaging union in the form in which it leaves the flow pack machine. Only when brought into the presently proposed special arrangement (loops) is this possible. The stretched packaging union leaving the packaging machine cannot be readily deflected in all directions located in the plane of the "flat" union. Only deflections out of the plane are possible, which e.g. also includes a rotation of the strip-like union for a lateral deflection. This restriction does not exist with the loop arrangement according to the invention. Shortly after loop formation, the new arrangement of the packaging line can be conveyed in a random direction in a relatively small radius solely limited by the conveying chain.

Figure 4:
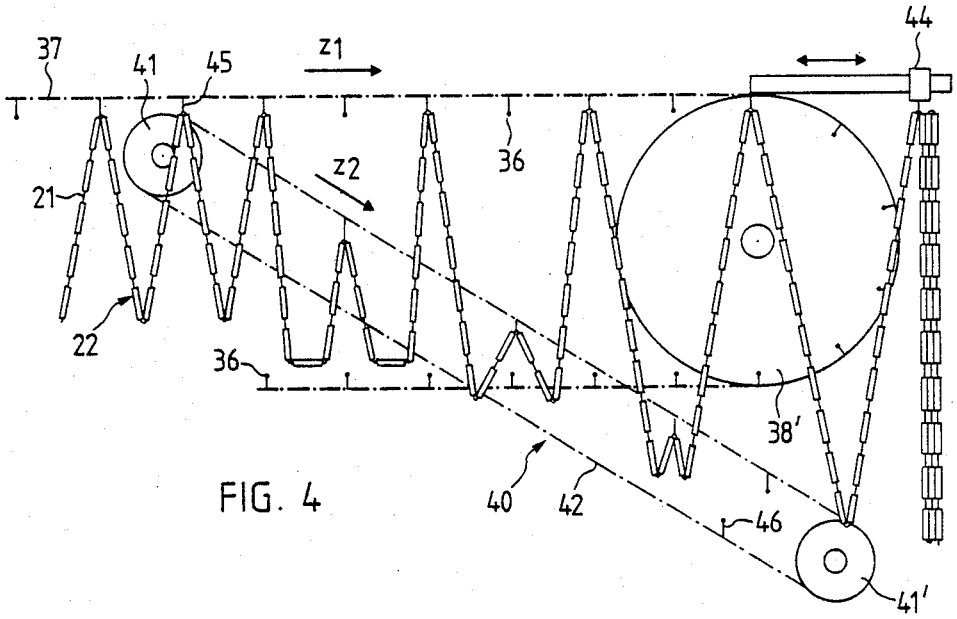
FIG. 4 a process part after product transfer.

FIG. 4 shows a further manipulation of the flow pack union with a diagrammatically represented apparatus for carrying out this manipulation. If the loop length is so set means of the first loop-forming collecting device 34 that the material flow can be transferred from one room into another through an existing wall opening, in certain circumstances this loop length may no longer be optimum for further processing, such as buffering, storing, etc. A further loop manipulation changes the length of the loops and comprises the operation of doubling the loop length. An auxiliary device 40, which is fundamentally constructed in the same way as the main device, with an endless chain 42 having hooks 46 running over guide wheels 41, 41" is used for receiving or taking over certain flow pack loops. The process-inherent ordering element is the suspension or attachment of the loops, every other suspension or attachment being used. The function according to FIG. 4 is as follows. The flow pack loops conveyed in the direction of arrow Z1 are transferred in a timed ratio from the main line of the main device to a secondary line of the auxiliary device (major loop/minor loop, i.e. in this example at station 45 of the overall device every other loop of the flow pack union is transferred to the hooks 46 of auxiliary device 40, from where said loop part is conveyed under a given angle of inclination in arrow direction Z2 and in synchronous manner up to the lower top or apex of the new extended loop. No action has to be taken for hanging out the auxiliary device hooks 46, because in the case of 3-dimensional conveying these advantageous aspects are treated as process-inherent ordering elements. Thus, no additional ordering element (with additional apparatus parts) is introduced into the process. It is irrelevant whether the guide wheel 41 has the end of the secondary line at the hanging out point, is in the vicinity or further removed therefrom, the hanging out of the loops being brought about by the divergent path in direction Z2. An unnecessary lengthening of the conveying chains is naturally avoided for cost reasons, so that the represented auxiliary device is in accordance with specific requirements.

Another measure of the method is another collecting device 44 on guide wheel 38' of the main device, i.e. on the main line. It is clear that the extended loops could also be conveyed on and at this point there is no need for a chain guide wheel 38' as the end of the main line. Mention has already been made of a slowing down or stopping of the material flow and whereas slowing down has already been discussed, reference will now be made to the stopage in conjunction with FIG. 5. The collecting device 44 shown in FIG. 4 can operate of a storage means shown in FIG. 5 for the automatic storage of the as yet still unsingled flow pack union. In the diagrammatic representation of FIG. 5 the hanging flow pack loops are arranged in spiral manner, e.g. with a device shown in FIG. 6. To give an idea of the "spatial" activity, reference is made to the example of chocolate manufacture. A union only 2 m high and with a diameter of 2 m covers approximately 30,000 chocolate bars with a total weight of over 3 tonnes. The original process-inherent ordering elements are still present, e.g. the product portions in fixed series, so that the flow pack union can be readily brought for further processing to a desired transfer or processing speed in any space position and if necessary e.g. to the original process speed of 1.2 m/s, which is not possible with the presently known methods. Thus, during storage, not only is the product stopped, but in fact the function is stopped. After storage or stoppage, at any time the stopped function can be resumed, which is also not the case with the presently known methods. Another advantage of this storage form is that despite 3 tonnes of spatially dense packed product, none of the chocolate portions are exposed to a stacking pressure. The characteristics of hose or tube packing and process-inherent ordering elements, i.e. in this case the unsingled flow pack union, are used of achieving during intermediate storage a storage form which leads to limited stressing of the product and with a high space filling factor.

Figure 5:
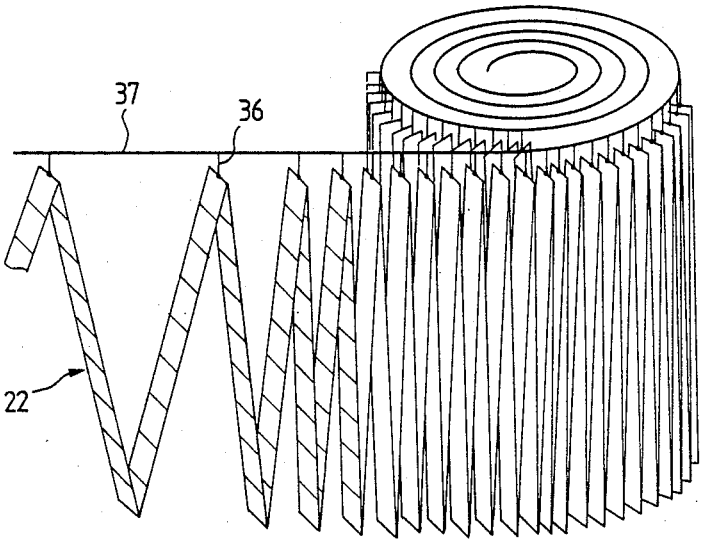
FIG. 5, a typical product formation for the purpose of storage, buffering or conveying a product output.

The storage form according to FIG. 5 is only one of several possibilities for arranging flow pack loops in volume-dense manner. The represented form is mainly suitable for intermediate storage, where no part is played by the first-in-last-out aspect when reactivated. However, apparatuses can also be realized, in which the loops are suspended in zig-zag form in curtain-like manner and permit a first-in-first-out removal. In the case of such a spatial arrangement within a manufacturing process a space-saving buffer can be obtained, which is able to store up to 10 tonnes of flow pack union during the production process, i.e. without having to slow the process down. Whereas high speed processes can take place in sections upstream and downstream of the buffer store, the transfer rate of the material flow can be reduced at random, down to temporary stoppage, without it being necessary to split up the flow pack union, which can be hundreds of meters long.

Figure 6:
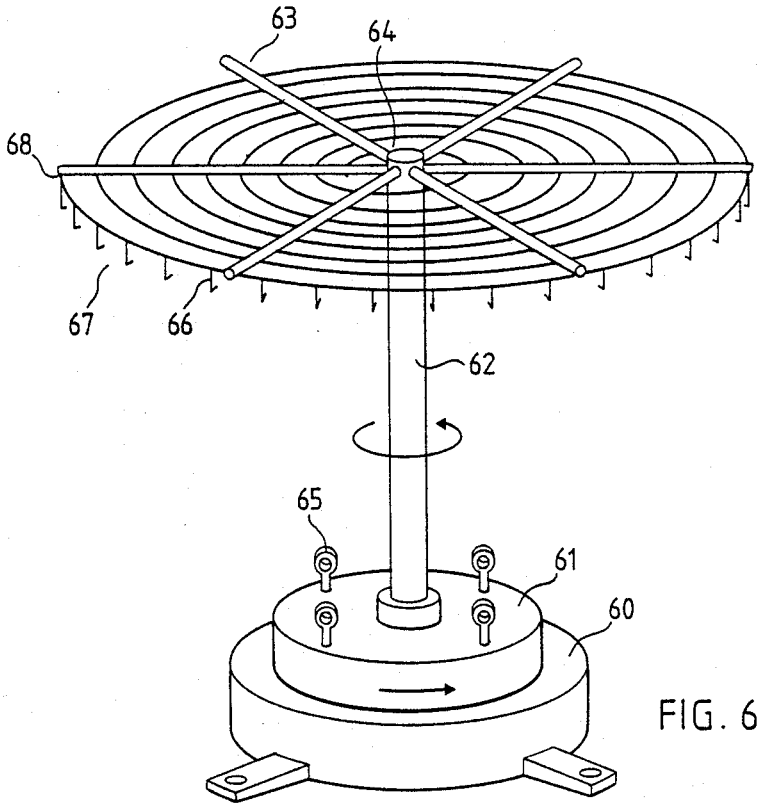
FIG. 6, an apparatus for producing the formation according to FIG. 5.

FIG. 6 shows a very simple apparatus making it possible to produce a spirally arranged flow pack union of the type shown in FIG. 5. The apparatus essentially comprises a drive base or socket 60, in whose foot 61 is placed a rotatable post 62, which on its other end carries on a support member 63 an arrangement of conveying means 67 with receptacles 66 constructed as a flat spiral. The drive socket is equipped with a not shown electric motor, which by means of a not shown gear drives the foot 61 of rotatable post 62, as indicated by the two rotation arrows. According to this simple construction mode of the post, of which there are larger numbers than there are drive sockets, it is possible to move the collecting device 44 between individual receptacles in much the same way as the pickup arm of a record player.

Thus, collecting device 44 (FIG. 4) is positioned close to the centre 64 of the flat, synchronously rotating conveying means spiral, so that the transfer of the loop apex starts with the innermost receptacles and ends with the outermost receptacles, e.g. at terminal 68. The thus suspended loops then form a spatial union, as shown in FIG. 5.

Figure 7:
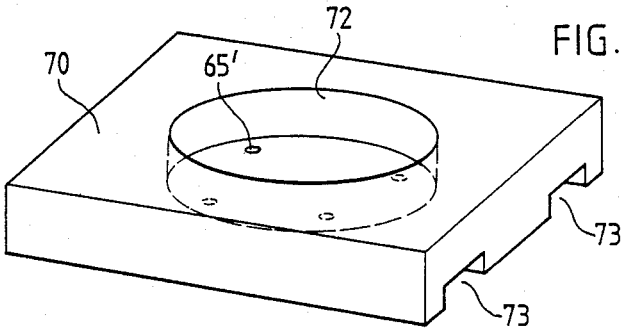
FIG. 7, a transportation base (pallet) for the apparatus according to FIG. 6.

FIG. 7 shows an aid for the conveying of suspended, empty posts. In the sense of a standardized intersection, it is a body 70 with pallet grooves 73 for the insertion of the forks of a fork-lift truck and a depression for receiving the foot 61 of a post. The fixing and retaining means 65, 65' shown in FIGS. 6 and 7 are strong bolts with a ring on one and a screw thread on the other end. Correspondingly dimension rods of a lifting mechanism can be inserted through the rings for the insertion and lifting out of the post, which can be raised in tilt-proof manner from the drive socket on pallet body 70. For transportation purposes, foot 61 can be secured on the pallet body by screwing bolts 65 into tap holes 65'.

Thus, the drive socket 60 is part of the loop means and the post constitute a type of return bundle. In the represented manner, the numerous posts can be inexpensively manufactured, including the pallet body, which can be used for transportation and storage purposes. Pallet body economies are possible in special storage areas as a result of tap holes in the base and centering depressions for facilitating insertion. The emptying of a full or partly loaded post takes place in the reverse manner to loading and with using the same means. The loop apexes are received by the receptacles of another conveying means and conveyed on for further processing.

What is claimed is:

1. A method for ordering a coherent packaging line in a high speed process by varying the kinetic energy thereof and maintaining its process inherent order, comprising the steps of:

taking up sectionwise the packaging line discharged at full process speed from a first production stage by the engagement of a support member with said packaging line between two individual product portions thereof, and a sequential engagement with a plurality of support members, each support member engaged between two additional individual product portions such that hanging first-formed loops are positioned between said support members with the aid of weight of the material such that said support members form apexes of said loops;

varying a distance between loop apexes according to a required process speed of a second production stage, storage unit or intermediate buffer; and varying the length of each loop by making second-formed loops by releasing or reforming loop apexes intermediate said apexes of said first-formed loops by a plurality of second support members traveling a different path from said support members of said first-formed loops.

2. A method according to claim 1, wherein by further loop manipulations by release and/or re-formation, third, fourth, etc. formed loops are obtained.

3. A method according to claim 1, wherein in the case of hanging loops having an upper and a lower loop apex, the upper loop apexes are arranged in a flat spiral.

4. A method according to claim 1, wherein in the case of hanging loops having an upper and a lower loop apex, the upper loop apexes are brought into a flat zig-zag arrangement.

5. A method according to claim 1, wherein by releasing loop apexes from first-formed loops, twice as long, second-formed loops are obtained.

6. A method according to claim 1, wherein by reforming loop apexes from first-formed loops, shortened, second-formed loops are obtained.

7. An apparatus for ordering a coherent packaging line in a high speed process by varying the kinetic energy thereof and maintaining to process inherent order, comprising:

conveying means having a plurality of receptacles for supporting loops of said packaging line;

at least one collecting means cooperating with said conveying means and having at least one gripper for receiving a packaging line from a packaging machine and for gripping the packaging line between individual product portions to form loop apexes; and means for performing a collecting stroke enabling the packaging line received from the gripper to be transferred to a receptacle on the conveying means.

8. An apparatus according to claim 7, wherein the conveying means with receptacles is guided by means of guide wheels and is constructed as endless means.

9. An apparatus according to claims 2 and 7, wherein the collecting device is length-adjustable for adjusting a variable collecting stroke.

10. An apparatus according to claim 9, wherein a collecting device is provided on each guide wheel.

11. An apparatus according to one of the claims 7 and 11, wherein a second conveying means with receptacles is associated with the first conveying means with receptacles.

12. An apparatus according to claim 11, wherein the second conveying means with receptacles is guided over guide wheels and is constructed as an endless means.

13. An apparatus according to claim 12, wherein the first conveying means and second conveying means run in the same direction and are reciprocally arranged at an angle to the force of gravity.

14. An apparatus according to one of the claims 7 and 8, wherein there is an equidistant arrangement of the receptacles on the conveying means.

* * * * *